US006189254B1

(12) United States Patent
Steitz

(10) Patent No.: US 6,189,254 B1
(45) Date of Patent: Feb. 20, 2001

(54) MAGAZINE CARTRIDGE LOADING DEVICE

(76) Inventor: Arthur R. Steitz, 375 N. Ash, Wood Dale, IL (US) 60191

( * ) Notice: Under 35 U.S.C. 154(b), the term of this patent shall be extended for 0 days.

(21) Appl. No.: 08/398,967

(22) Filed: Mar. 2, 1995

(51) Int. Cl.[7] ..... F42B 39/00
(52) U.S. Cl. ..... 42/87
(58) Field of Search ..... 42/87, 88, 89, 42/90

(56) References Cited

U.S. PATENT DOCUMENTS

| | | | | |
|---|---|---|---|---|
| 863,798 | * | 8/1907 | Hodges | 42/87 |
| 3,890,733 | * | 6/1975 | Kubik | 42/89 |
| 4,402,153 | * | 9/1983 | Peter et al. | 42/89 |
| 4,679,343 | * | 7/1987 | Gomez Harlow | 42/87 |
| 4,689,909 | | 9/1987 | Howard . | |
| 4,869,009 | * | 9/1989 | Bennett | 42/87 |
| 4,888,902 | | 12/1989 | Knowles . | |
| 5,249,386 | | 10/1993 | Switzer . | |
| 5,309,660 | | 5/1994 | Blackamore . | |
| 5,355,606 | | 10/1994 | Origoni . | |

OTHER PUBLICATIONS

"New Products," *Guns*, Nov., 1995, p. 102.

* cited by examiner

*Primary Examiner*—Stephen M. Johnson
(74) *Attorney, Agent, or Firm*—Marshall, O'Toole, Gerstein, Murray & Borun

(57) ABSTRACT

In order to simplify manually loading cartridges into a magazine, a device is provided for use with a magazine that receives a plurality of cartridges in stacked relation through an opening against a force biasing the cartridges toward the opening. The device includes a band configured in size and shape for placement on a thumb of one hand for loading the magazine with the cartridges when the magazine is gripped by that one hand. The device also includes a projection integrally associated with the band and extending from an outer surface of the band for engagement of a top one of the cartridges previously loaded into the magazine. With this arrangement, the projection has a surface adapted to contact a surface of the cartridges in such manner as to engage the top one of the cartridges when the magazine is gripped for depressing the top one of the cartridges away from the opening against the biasing force in response to a bending/depressing thumb motion.

18 Claims, 1 Drawing Sheet

MAGAZINE CARTRIDGE LOADING DEVICE

FIELD OF THE INVENTION

The present invention is generally directed to cartridge loading in a firearm magazine and, more particularly, to a simplified device for manually loading cartridges into a firearm magazine.

BACKGROUND OF THE INVENTION

Generally speaking, the problems associated with loading cartridges into a firearm magazine are well known. This is particularly true for manual, or hand, loading where it is necessary to depress all previously loaded cartridges which are typically received through an opening in the magazine so as to lie in stack relationship since there is conventionally a spring for biasing the cartridges toward the opening and against which the previously loaded cartridges must be depressed. In addition to the biasing force of the spring, the cartridges are not large in size and, thus, are particularly difficult to manually manipulate.

Nevertheless, it is common practice to load cartridges into a firearm magazine by progressive compression of the magazine's spring. The cartridges are inserted one at a time against the ever increasing spring resistance as the magazine approaches a fully loaded condition. If the next cartridge is simply loaded against the previously loaded cartridge, it is recognized that considerably force and manual dexterity are required.

Over the years, the unaided loading of a firearm magazine in the described manner has become undesirable. It is not only time consuming and difficult, but manual loading without any manual assistance can lead to misalignment of cartridges within the magazine and, as a result, to jamming of the cartridges therewithin. In order to overcome such problems, there have been many different types of complicated manual devices proposed over the years.

By way of example, Switzer U.S. Pat. No. 5,249,386 discloses one type of device that has been commercialized. It is, unfortunately, inordinately complex and quite bulky in size, both of which are undesirable characteristics of any firearm accessory. Still further, the considerable complexity of the device is such that it can be subject to mechanical failure after a period of use.

Referring to Howard U.S. Pat. No. 4,689,909, there is another such manual magazine loading device that is disclosed. It, too, is relatively complex and large in size which is undesirable since the typical firearms enthusiast has only limited space for accessories such as a magazine loader in a typical accessory bag that is carried. With such serious restrictions on accessories, the device disclosed in Howard U.S. Pat. No. 4,689,909 is less than fully desirable.

In a very recent attempt at improvement over the prior art, Blackamore U.S. Pat. No. 5,309,660 discloses an entirely redesigned cartridge magazine that utilizes a spring engaged elevator. The magazine has a slot and the elevator has a hole or recess aligned with the slot for receiving a key. With this arrangement, the key can be utilized to depress the elevator against a spring for loading additional cartridges.

While ingenious, Blackamore U.S. Pat. No. 5,309,660 does nothing to deal with the problem of already existing magazines. It is also clearly quite expensive in nature and would require complete retooling for the magazine as well as possible reforming of the portion of a firearm adapted to receive the redesigned magazine. As a result, there has remained the problem of providing a device that is suitable for manually loading essentially every existing magazine.

As will be appreciated, the problem that is presented is to provide a device that is simple and inexpensive but achieves the goal of providing an effective manual cartridge loading device. This is especially important for firearm enthusiasts that may suffer from a disability such as an arthritic condition that makes it difficult to load cartridges by hand. Accordingly, the present invention is directed to overcoming one or more of the foregoing problems and achieving one or more of the resulting objects.

SUMMARY OF THE INVENTION

It is therefore a principal object of the present invention to provide a device for manually loading cartridges into a magazine. It is a further object of the present invention to provide such a device that can be used with nearly every existing magazine of the type which is adapted to receive a plurality of cartridges in stacked relationship through an opening and against a force tending to bias the cartridges toward the opening. It is an additional object of the present invention to provide a simplified device comprising a band and cartridge engaging projection.

Accordingly, the present invention is directed to a device for manually loading cartridges into a magazine. The magazine is of the type which is adapted to receive a plurality of cartridges in stacked relation, and it has an opening for receiving the cartridges and means for biasing the cartridges toward the opening. The device includes a band configured in size and shape for placement on a thumb of one hand for loading the magazine with cartridges when the magazine is gripped by that one hand. The device also includes a projection integrally associated with the band and extending from an outer surface of the band for engagement of a top one of the cartridges previously loaded into the magazine. The projection has a surface adapted to contact a surface of the cartridges in such manner as to maintain engagement with the top one of the cartridges when the magazine is gripped. The projection engages the top one of the cartridges for depressing it away from the opening against the biasing means in response to a bending/depressing thumb motion. When the device is placed on the thumb and the projection is used to depress the top cartridge, another cartridge can be manually loaded into the magazine by using the opposite hand.

In the exemplary embodiment, the band is formed as a continuous ring having a flat inner surface. It is also advantageous for the band to be formed to have curved inner edges. Still additionally, the projection preferably comprises a straight, rigid rod having a curved end defining the cartridge conforming surface.

In a most highly preferred embodiment, the band is formed as a continuous non-circular ring having a major dimension measured generally along a major axis thereof and a minor dimension measured generally along a minor axis thereof. The flat inner surface of the band is advantageously formed to be generally axially extending and the straight, rigid rod is such that it preferably extends generally perpendicular to the major axis along a line extending through the point of intersection of the major and minor axis. With this arrangement, the straight, rigid rod also is preferably formed to have a curved surface on the end remote from the continuous non-circular ring generally conforming to a cylindrical surface of the cartridges.

As for other details of the invention, the rod is preferably formed to have a length dimension which is less than the minor dimension of the continuous ring. Furthermore, the rod is advantageously formed to have a length dimension approximately the same as a width dimension of the continuous ring.

Still other objects, advantages and features of the present invention will become apparent from a consideration of the following specification taken in conjunction with the accompanying drawings.

DETAILED DESCRIPTION OF THE PREFERRED EMBODIMENT

Figure 1:
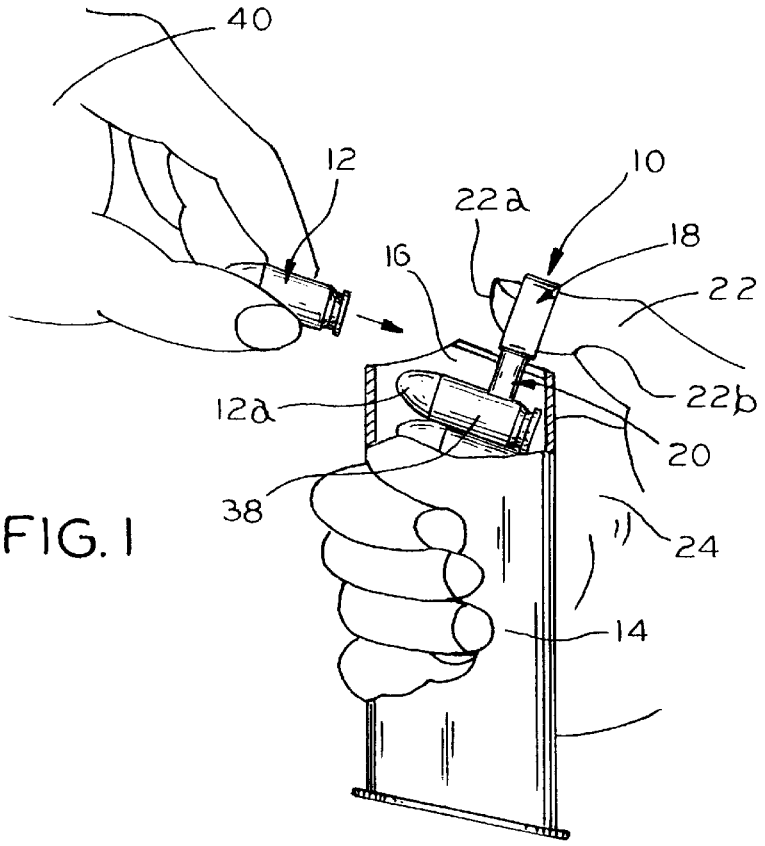
FIG. 1 is a perspective view showing utilization of a manual cartridge loading device in accordance with the present invention.

In the illustrations given, and with reference first to FIG. 1, the reference numeral 10 designates generally a device for manually loading cartridges 12 into a magazine 14. The magazine 14 is adapted to receive a plurality of the cartridges 12 in stacked relation therewithin, and it has an opening 16 for receiving the cartridges 12 as well as means for biasing the cartridges 12 toward the opening 16 in the form of the spring (not shown). As will be appreciated from FIGS. 2–4, the device 10 includes a band 18 as well as a projection 20 for manually loading a cartridge 12 into the magazine 14 as will be described in greater detail hereinafter.

Figure 2:
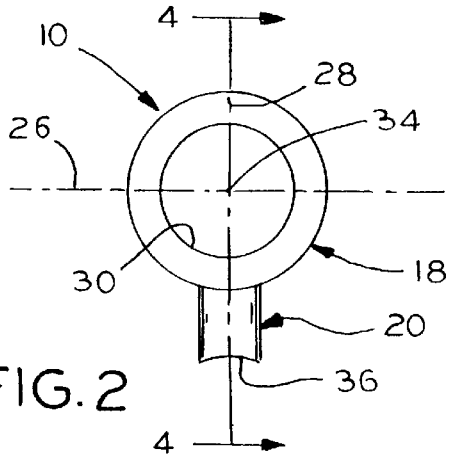
FIG. 2 is a front elevational view of the manual cartridge loading device of FIG. 1.
Figure 3:
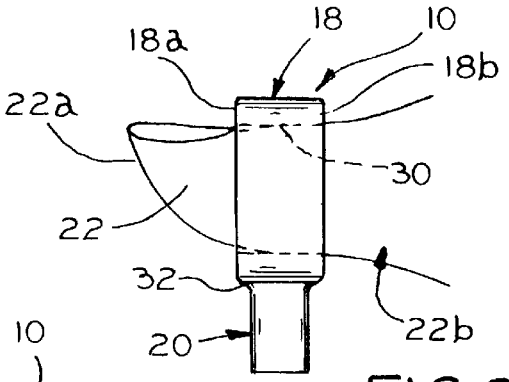
FIG. 3 is a side elevational view of the manual cartridge loading device of FIG. 1.
Figure 4:
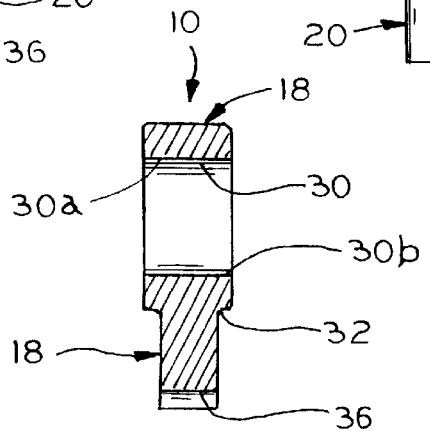
FIG. 4 is a cross-sectional view of the manual cartridge loading device of FIG. 1 taken generally along the line 4—4 of FIG. 2.

Still referring to FIGS. 2–4, the band 18 is configured in size and shape for placement on a thumb 22 of one hand 24 (see, also, FIG. 1) for loading the magazine 14 with the cartridges 12 when the magazine 14 is gripped by the one hand 24. The band 18 is formed as a continuous non-circular ring having a major dimension measured generally along a major axis 26 thereof and a minor dimension measured generally along a minor axis 28 thereof, and it is defined by a flat, axially extending inner surface 30 having curved inner edges 30*a* and 30*b* as best shown in FIG. 4. With this arrangement, the projection 20 is integrally associated with the band 18 to extend from an outer surface as at 32 of the band 18 for engagement of a top one 12*a* of the cartridges 12 previously loaded into the magazine 14.

As will be appreciated, the projection 20 comprises a straight, rigid rod extending generally perpendicular to the major axis 26 along a line extending through the point of intersection 34 of the major axis 26 and the minor axis 28. The straight, rigid rod 20 has a curved surface 36 on the end thereof remote from the band 18 generally conforming to a cylindrical surface 38 of the cartridges 12 (see FIG. 1) when the magazine 14 is gripped by the one hand 24. Referring specifically to FIG. 1, the continuous ring 18 and rod 20 cooperate to depress the top one 12*a* of the cartridges 12 in the magazine 14 away from the opening 16 in the magazine 14 against force imparted by the magazine spring responsive to a bending/depressing thumb motion.

With the foregoing features, the manual cartridge loading device 10 is particularly well suited for manually loading cartridges 12 into the magazine 14 by using the other hand 40 (see FIG. 1). It is advantageous in this connection for the straight, rigid rod 20 to be formed so as to have a length dimension less than the minor dimension of the continuous ring 18 as measured along the minor axis 28 and to also be formed to have a length dimension approximately the same as a width dimension of the continuous ring 18, i.e., approximately the same dimension as the width measured between opposing surface 18*a* and 18*b* as shown in FIG. 3. It is believed that this particular arrangement gives significant stability to the manual cartridge loading device 10 in that it may be placed on the thickest part of the thumb 22 between the tip 22*a* and the first joint 22*b* and will not be subject to rotation relative to the thumb due to the considerable axial length of the flat inner surface 30, the non-circular shape of the continuous ring 18, and the relatively short length of the rod 20. In addition, due to the curved inner edges 30*a* and 30*b* as shown in FIG. 4, there are no sharp edges that might otherwise have a tendency to cut into the thumb 22 as it is made to undergo a bending/depressing thumb motion.

In one particular embodiment, the continuous ring 18 has a major dimension on the order of approximately 0.87 inches measured internally of the continuous ring 18 and of approximately 1.125 inches measured externally of the continuous ring 18. The same embodiment has a minor dimension of approximately 0.73 inches measured internally of the continuous ring and of approximately 1.000 inches measured externally of the continuous ring. Still further, in this embodiment, the rod 20 is formed to have a length dimension of approximately 0.500 inches and the continuous ring 18 is formed to also have a width dimension of approximately 0.500 inches.

In the aforementioned embodiment, the dimensions have been found suitable for utilization of the manual cartridge loading device for many of the enthusiasts who manually load magazines. It is, of course, possible to manufacture a variety of different sizes should the need arise, particularly for those having very small and/or very large hands and thumbs. However, even for the largest hand and thumb, the manual cartridge loading device 10 is believed to clearly meet all of the requirements for such a device as noted in detail hereinabove.

More specifically, the device 10 is very small in overall size since it is no larger than approximately 1.500 inches in any one direction. It, thus, easily fits into a firearms accessory bag without taking up valuable space needed for other accessories including cartridges that necessarily must be carried by the firearms enthusiast. Despite this fact, the device 10 is very effective for its intended purpose and very inexpensive in terms of its manufacturing costs.

As for its effectiveness, the manual cartridge loading device 10 is easily placed upon the thumb 22 of the hand 24 generally as shown in the drawings (see FIGS. 1 and 3). The magazine 14 can then be firmly gripped in the palm and with the remaining fingers substantially as shown in FIG. 1. In this position, the thumb 22 can impart considerable force in terms of its leverage through manual cartridge loading device 10 when subjected to a bending/depressing thumb motion.

As for materials, the manual cartridge loading device 10 can be manufactured from any of a variety of different materials. It may, by way of example, be formed of stainless steel, brass, plastic, or any other rigid material capable of being configured as shown in the drawings and undergoing the forces that are normally expected in depressing a stack of cartridges 12 against the biasing force of a spring. With any material, the manual cartridge loading device 10 represents a vast improvement over the complex devices of the prior art.

While in the foregoing there has been set forth a preferred embodiment of the invention, it will be appreciated that the details herein given may be varied by those skilled in the art without departing from the true spirit and scope of the appended claims.

I claim:

1. A device for manually loading cartridges into a magazine which is adapted to receive a plurality of cartridges in stacked relation therewithin, said magazine having an opening for receiving said cartridges and means for biasing said cartridges toward said opening, said device comprising:

a band configured in size and shape for placement on a thumb of one hand for loading said magazine with said cartridges when said magazine is gripped by said one hand, and a projection integrally associated with said band and extending from an outer surface of said band for engagement of a top one of said cartridges previously loaded into said magazine;

said projection having a surface adapted to contact a surface of said cartridges in such manner as to maintain engagement with said top one of said cartridges when said magazine is gripped by said one hand for depressing said top one of said cartridges away from said opening against said biasing means in response to a bending/depressing thumb motion;

whereby another of said cartridges can be manually loaded into said magazine by using the other hand.

2. The magazine loading device of claim 1 wherein said band is formed as a continuous ring.

3. The magazine loading device of claim 1 wherein said band is formed to have a flat inner surface.

4. The magazine loading device of claim 1 wherein said band is formed to have curved inner edges.

5. The magazine loading device of claim 1 wherein said projection comprises a straight, rigid rod.

6. The magazine loading device of claim 1 wherein said cartridge contacting surface is curved.

7. A device for manually loading cartridges into a magazine which is adapted to receive a plurality of cartridges in stacked relation therewithin, said magazine having an opening for receiving said cartridges and means for biasing said cartridges toward said opening, said device comprising:

a band configured in size and shape for placement on a thumb of one hand for loading said magazine with said cartridges when said magazine is gripped by said one hand, said band being formed as a continuous ring defined by a flat inner surface having curved inner edges, and a projection integrally associated with said band to extend from an outer surface of said band for engagement of a top one of said cartridges previously loaded into said magazine;

said projection comprising a straight, rigid rod having a surface on the end thereof remote from said band generally conforming to a surface of said cartridges so as to maintain engagement with said top one of said cartridges when said magazine is gripped by said one hand for depressing said top one of said cartridges away from said opening against said biasing means in response to a bending/depressing thumb motion;

whereby another of said cartridges can be manually loaded into said magazine by using the other hand.

8. The magazine loading device of claim 7 wherein said continuous ring comprising said band is formed to have a non-circular shape configuration.

9. The magazine loading device of claim 7 wherein said continuous ring comprising said band is formed to have a major dimension and a minor dimension.

10. The magazine loading device of claim 9 wherein said rod is integral with said continuous ring so as to extend generally perpendicular to said major dimension.

11. The magazine loading device of claim 9 wherein said rod is formed to have a length dimension less than at least said major dimension of said continuous ring.

12. The magazine loading device of claim 10 wherein said rod is formed to have a length dimension approximately the same as a width dimension of said continuous ring.

13. A device for manually loading cartridges into a magazine which is adapted to receive a plurality of cartridges in stacked relation therewithin, said magazine having an opening for receiving said cartridges and means for biasing said cartridges toward said opening, said device comprising:

a band configured in size and shape for placement on a thumb of one hand for loading said magazine with said cartridges when said magazine is gripped by said one hand, said band being formed as a continuous non-circular ring having a major dimension measured generally along a major axis thereof and a minor dimension measured generally along a minor axis thereof and being defined by a flat, axially extending inner surface having curved inner edges, and a projection integrally associated with said band to extend from an outer surface of said band for engagement of a top one of said cartridges previously loaded into said magazine;

said projection comprising a straight, rigid rod extending generally perpendicular to said major axis along a line extending through the point of intersection of said major axis and said minor axis, said straight, rigid rod having a curved surface on the end thereof remote from said band generally conforming to a cylindrical surface of said cartridges so as to maintain engagement with said top one of said cartridges when said magazine is gripped by said one hand, said continuous ring and rod cooperating to depress said top one of said cartridges in said magazine away from said opening in said magazine against force imparted by said biasing means in response to a bending/depressing thumb motion;

whereby another of said cartridges can be manually loaded into said magazine by using the other hand.

14. The magazine loading device of claim 13 wherein said rod is formed to have a length dimension less than said minor dimension of said continuous ring.

15. The magazine loading device of claim 13 wherein said rod is formed to have a length dimension approximately the same as a width dimension of said continuous ring.

16. The magazine loading device of claim 13 wherein said continuous ring has a major dimension on the order of approximately 0.87 inches measured internally of said continuous ring and of approximately 1.125 inches measured externally of said continuous ring.

17. The magazine loading device of claim 13 wherein said continuous ring having a minor dimension of approximately 0.73 inches measured internally of said continuous ring and of approximately 1.000 inches measured externally of said continuous ring.

18. The magazine loading device of claim 13 wherein said rod is formed to have a length dimension of approximately 0.500 inches, and said continuous ring is formed to also have a width dimension of approximately 0.500 inches.

* * * * *